US007974561B2

(12) United States Patent
Yamano

(10) Patent No.: US 7,974,561 B2
(45) Date of Patent: Jul. 5, 2011

(54) BELT FIXING APPARATUS AND IMAGE FORMING APPARATUS

(75) Inventor: Miho Yamano, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 497 days.

(21) Appl. No.: 12/127,447

(22) Filed: May 27, 2008

(65) Prior Publication Data

US 2009/0067900 A1 Mar. 12, 2009

(30) Foreign Application Priority Data

Sep. 12, 2007 (JP) ..... 2007-236359

(51) Int. Cl.
*G03G 15/20* (2006.01)

(52) U.S. Cl. ..... 399/329

(58) Field of Classification Search ..... 399/329, 399/328, 331, 122; 219/216
See application file for complete search history.

(56) References Cited

U.S. PATENT DOCUMENTS 4,812,873 A * 3/1989 Inagaki et al. ..... 399/331
2005/0191097 A1 * 9/2005 Yoshida et al. ..... 399/329

FOREIGN PATENT DOCUMENTS

JP 2004-206105 7/2004

* cited by examiner

*Primary Examiner* — David M Gray
*Assistant Examiner* — Billy J Lactaoen
(74) *Attorney, Agent, or Firm* — Cantor Colburn LLP

(57) ABSTRACT

A belt fixing apparatus for fixing a toner image on a recording material in a nip portion having: an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material.

4 Claims, 5 Drawing Sheets

BELT FIXING APPARATUS AND IMAGE FORMING APPARATUS

CROSS-REFERENCE TO RELATED APPLICATION

The present application is based on Japanese Patent Application No. 2007-236359 filed with Japan Patent Office on Sep. 12, 2007, entire content of which is hereby incorporated by reference.

FIELD OF THE INVENTION

The present invention relates to a belt fixing apparatus for fixing a toner image on a recording material in the nip portion formed between an endless fixing belt and a fixing member, and an image forming apparatus equipped with this belt fixing apparatus.

BACKGROUND

In the image forming apparatus that uses an electrophotographying method such as a copying machine, a printer, a facsimile and a multi-function peripheral equipped with many of these functions, a latent image corresponding to a document is formed onto a photoconductive drum; a toner is applied to this latent image to visualize this toner image; this toner image is transferred onto the recording material; and the toner image is fixed onto the recording material.

In addition, in case of forming a color image, after the latent images of Y, M, C and K corresponding to a document color are formed onto four photoconductive drums and the toner images of four colors is primarily transferred onto an intermediate belt, the toner image transferred onto the recording material is fixed and the toner image transferred onto the recording material is ejected.

As described above, as a fixing apparatus for fixing a toner image, there is provided a fixing apparatus for heating/pressing the recording material, onto which a toner image has been transferred while nipping and transferring the recording material by a nip portion formed between a fixing roller, which contains a heating device, such as a halogen lamp, and a pressing roller, which presses the fixing roller. Since structure is simple, such a fixing apparatus is widely used.

By the way, in order to attain improvement in the speed, it is necessary to supply sufficient quantity of heat for the recording material with which the toner was transferred, and in such fixing apparatus, it is necessary to make a nip width wide for the purpose. In order to make the nip width wide, it is feasible to increase the load of the pressing roller for pressing the fixing roller, the thickness of the elastic layer formed from the silicone rubber in the pressing roller and the diameter of two rollers.

However, when the load of the pressing roller and the thickness of the elastic layer are increased, there is a possibility that the nip width of an axial direction may become uneven and the crease of the recording material and fixing unevenness may occur. In addition, when the diameter of the roller is increased, the fixing apparatus is not only enlarged, but there is a problem that warming up time becomes long.

In order to solve this problem, there has been disclosed in the Official Gazette, a fixing apparatus of a so-called FBNF (Free Belt Nip Fuser) system having a fixing roller, which has an elastic layer formed from silicone rubber and contains a heating device, such as, a halogen lamp in the center, a fixing belts of an endless style, which is driven and rotated by the fixing roller and a pressing pad, which presses the fixing roller through the fixing belt from the inside of the fixing belt, which heats and presses the recording material, onto which the toner image has been transferred, in the nip portion which is formed by the fixing roller and the fixing belt. (For example, Unexamined Japanese Patent Application Publication No. 2004-206105).

According to this fixing apparatus, the fixing belts, which was pressed by the pressing pad, is elastically deformed and a broad nip portion is formed between the fixing roller and the fixing belts. Therefore, it can respond to the improvement in the speed, and fixing apparatus is not enlarged. Furthermore, since the heat capacity of fixing belts is small, warming up time is shortened and it becomes energy saving.

Here, solid rubber is used as a pressing pad from a viewpoint of the needed load for fixing and durability, but sponge is not used.

In addition, it is necessary to make the pressure of the pressing pad into a uniform pressure distribution as a whole in a nip portion. When pressure distribution is not uniform, the fixed luminous intensity and density of an image will become uneven, an image gap will occur, or a crease is formed on the recording paper as a recording material.

On the other hand, the recording material, which has passed through the nip portion, may stick to the fixing roller by the adhesive power of melted toner. In order to prevent this, it is desirable to use a high pressure only in the end of the nip portion, and to carry out elastic deformation of the fixing roller with big curvature.

Thus, it is necessary that the pressure distribution of the nip portion is set high only in the end of the nip portion, and the pressure distribution to the others is set uniform. For this reason, it is necessary to structure the pressing pad into the form, which has such a pressure distribution.

With respect to processing methods of the solid rubber, which form a pressing pad, there exist a polishing process and molding by a metal mold.

In the case of the polishing process, when the solid rubber is limited to the rubber of high hardness and there is a size step by processing, big pressure differences will arise in the portion, and a fixing image will be influenced. In addition, when fixing an image onto the recording material with narrow width using the pressing pad formed by the rubber of high hardness, the step produced in the pressing pad by the edge remains without disappearing immediately. Then, when the image is fixed onto a wide recording material, there is a possibility that the step may appear in an image.

In molding by a metal mold, there is no restrictions of the hardness of rubber, and its degree of freedom of shape selections increases. However, it is easy to produce the variation in a size or hardness between one end of the longitudinal direction and the other end with temperature distribution, a cure rate and transfer pressure at the time of molding.

In the conventional fixing apparatus disclosed in Unexamined Japanese Patent Application Publication No. 2004-206105, since a pressing pad and an elastic pressing member are formed with one rubber, whether the process is a polishing process or molding by a metal mold, the problem described above arises. As a result, there is a possibility that a desired pressure distribution could not be easily realized in the nip portion, the luminous intensity and the density of the image, which has been fixed, may become uneven, an image gap may occur or a crease may be formed on the recording paper as a recording material. In addition, the reliability of apparatus was spoiled while becoming a high cost, since the yield in processing of the pressing pad was bad, and an inspection and adjustment took time.

An object of the present invention is to provide a belt fixing apparatus and an image forming apparatus equipped with the belt fixing apparatus, which are arranged to obtain a desired pressure distribution in a nip portion by forming a pressing pad and a pressing member as an elastic pressing member from a plurality of members to solve the problems described above.

SUMMARY

According to one aspect of the present invention, there is provided a belt fixing apparatus, the belt fixing apparatus for fixing a toner image on a recording material in a nip portion comprising: an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material.

DETAILED DESCRIPTION OF THE PREFERRED EMBODIMENTS

An embodiment pertaining to a fixing apparatus of the present invention will be described with reference to figures below.

Figure 1:
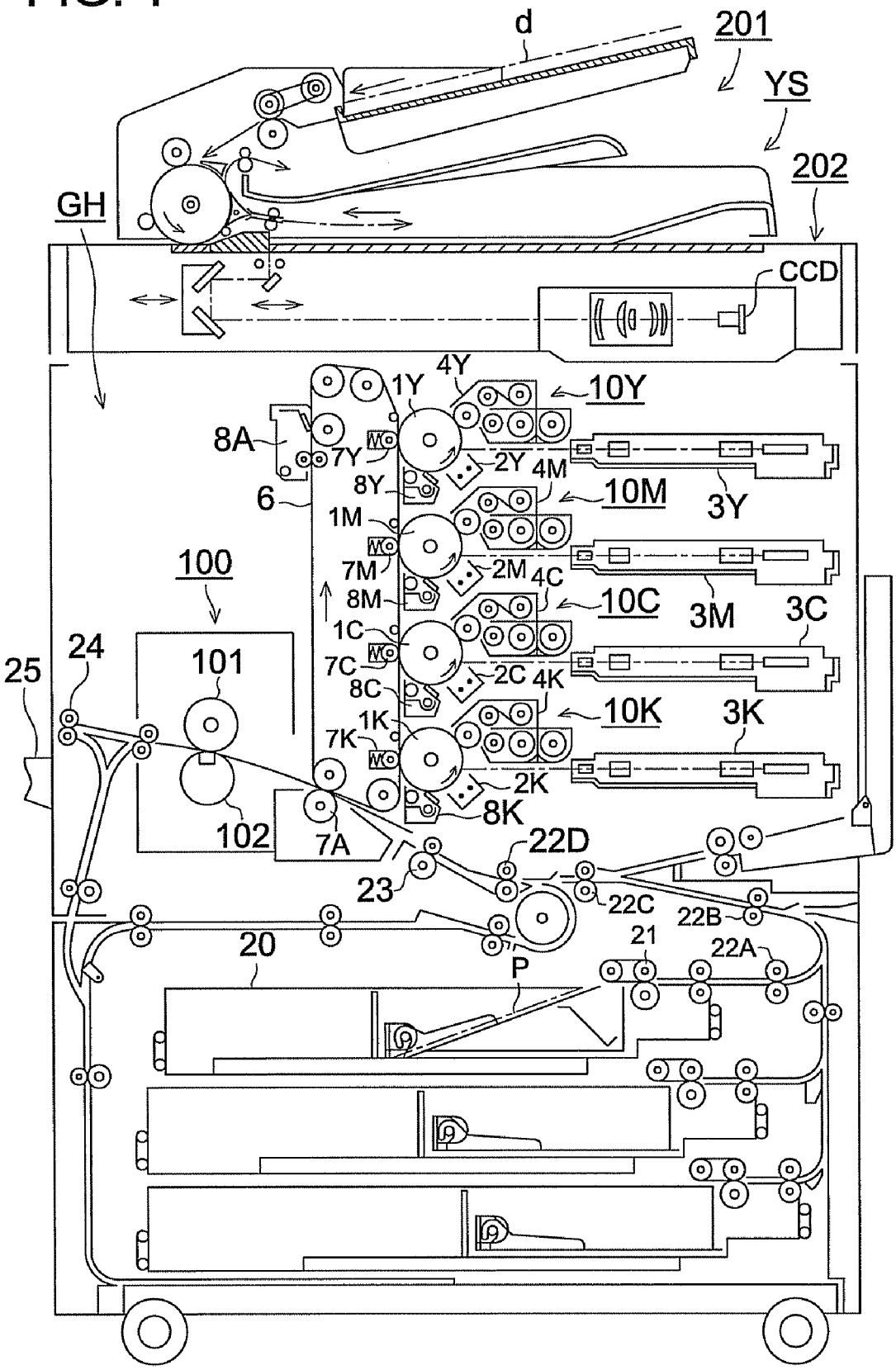
FIG. 1 illustrates a block diagram of an image forming apparatus.

Firstly, an example of an image forming apparatus using a fixing apparatus of the present invention will be described based on the block diagram of FIG. 1.

This image forming apparatus configured by an image forming apparatus main body GH and an image scanner YS.

The image forming apparatus main body GH is called a tandem type color image forming apparatus, and configured by a plurality of sets of image forming sections 10Y, 10M, 10C and 10K, a belt type intermediate transfer body 6, a paper feed & conveyance device and a fixing apparatus 9.

The image scanner YS, which is configured by an automatic document feeding apparatus 201 and a document image scanning and exposing apparatus 202, is installed in the upper portion of the image forming apparatus main body GH. The document "d" placed on the document table of the automatic document feeding apparatus 201 is conveyed by a conveyance device. Scanning and exposure of the image of one side or both sides of the document are carried out by the optical system of the document image scanning and exposing apparatus 202. Then the image is read into a line image sensor CCD.

In an image processing section, the formed signal, which as been converted from optical signals to electrical signals by the line image sensor CCD, is sent to the exposure devices 3Y, 3M, 3C and 3K, after analog processing, an A/D conversion, a shading compensation and an image compression process are performed.

An image forming section 10Y, which forms an image of a yellow (Y) color, arranges a charging device 2Y, an exposing device 3Y, a developing device 4Y and a cleaning device 8Y around the photoconductive drum 1Y. An image forming section 10M, which forms an image of a magenta (M) color, arranges a charging device 2M, an exposing device 3M, a developing device 4M and a cleaning device 8M around the photoconductive drum 1M. An image forming section 10C, which forms an image of a cyan (C) color, arranges a charging device 2C, an exposing device 3C, a developing device 4C and a cleaning device 8C around the photoconductive drum 1C.

An image forming section 10K, which forms an image of a black (K) color, arranges a charging device 2K, an exposing device 3K, a developing device 4K and a cleaning device 8K around the photoconductive drum 1K. And the charging device 2Y, the exposing device 3Y and the charging device 2M, the exposing device 3M and the charging device 2C, the exposing apparatus 3C, and the charging device 2K and the exposing device 3K configure a latent image forming device.

In addition, developing devices 4Y, 4M, 4C and 4K include the two-ingredient developer, which includes the toner and carrier of the diameter of granules of yellow (Y), magenta (M), cyan (C) and black (K).

The intermediate transfer body 6 is wound around a plurality of rollers and supported so as to be capable of rotating.

A belt fixing apparatus 100 heats, presses and fixes the toner image onto a recording paper sheet (recording material) P in the nip portion formed between the fixing roller 101, which is heated, and the fixing belt 102.

In this way, the image of each color formed by the image forming sections 10Y, 10M, 10C and 10K is transferred one by one onto the intermediate transfer body 6, which is rotating, by the transfer devices 7Y, 7M, 7C and 7K (primary transfer), and the toner image, which has been formed into a color image, will be formed. The recording paper sheet P accommodated in a paper sheet cassette 20 is fed by a feeding device 21. The recording paper sheet P is conveyed to a transfer device 7A through feed rollers 22A, 22B, 22C and 22D and a registration roller 23, and a color image is transferred onto the recording paper sheet P (secondary transfer). The recording paper sheet P, onto which the color image has been transferred, is heated and pressed so that the color toner image on the recording paper sheet P is fixed. Then, the recording paper sheet P is nipped by ejection rollers 24 and placed on a sheet ejection tray 25 outside the apparatus.

On the other hand, as for the intermediate transfer body 6, which carried out curvature separation of the recording paper sheet P, residual toner is removed by a cleaning device 8A after transferring the color image onto the recording paper sheet P by a transfer device 7A.

In addition, although the above was the image forming apparatus, which forms a color image, it may be the image forming apparatus, which forms a monochrome image, and although the intermediate transfer body is used, it is not necessary to be used.

Figure 2:
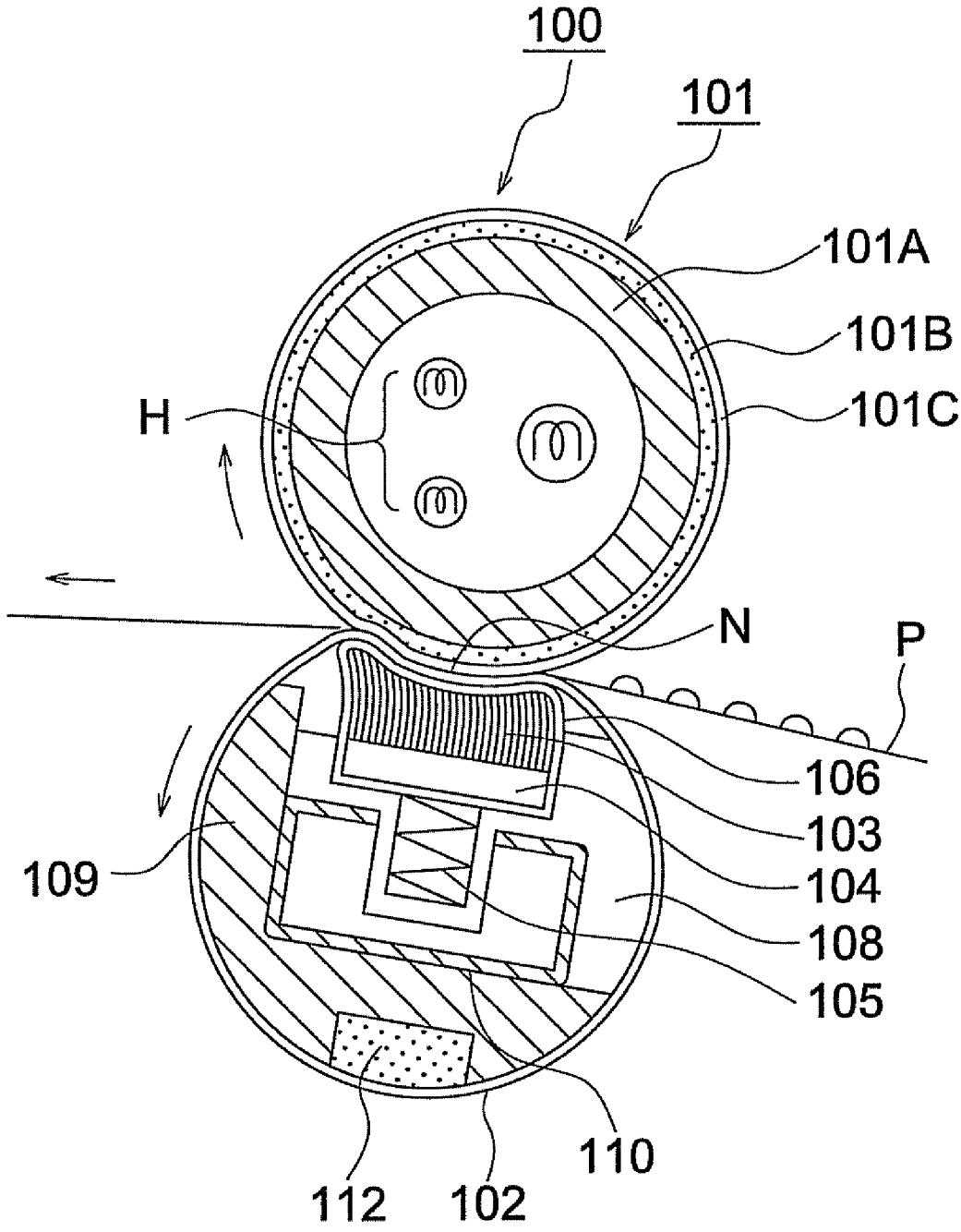
FIG. 2 illustrates a sectional view of a belt fixing apparatus.

Next, an embodiment of the belt fixing apparatus of the FBNF system using the present invention will be described with reference to FIG. 2. FIG. 2 is a sectional view, which perpendicularly crosses to the longitudinal direction of a fixing belt 102.

A fixing roller 101 (fixing member) includes a halogen lamp (heating device) H in the center. The fixing roller 101 is configured by a cylindrical metal core 101A, which was formed from aluminum and iron, an elastic layer 101B formed from heat-resistant high silicone rubber, which covers the cylindrical metal core 101A and furthermore, a releasing layer 101C, which covers the elastic layer 101B and formed from fluororesin, such as par fluoroalkoxy (it will be called PFA hereafter) or polytetrafluoroethylene (it will be called PTFE hereafter).

The fixing belt 102 is configured by a base substance formed from polyimide, and a releasing layer formed by PFA or PTFE, which covers the outside of the base substance, and is formed in an endless style. In addition, in the figures, since it becomes ambiguous when drawing the base substance and the releasing layer on the fixing belt 102 with thin thickness, they have been omitted.

Here, in order to form a nip portion N for pressing the fixing belt 102 to the fixing roller 101 to fix the recording material P, there is provided aggregate of a plurality of arrayed metal plates 103 (metal members), which can be bent by pressurization. And an edge face (torn surface of a board) opposes to the fixing roller 101, and each metal plate 103 is arranged in the conveyance direction of the recording material P. Each metal plate 103 is held by a holding member 104 whose root is formed from heat-resistant resin. In addition, the compression spring 105 is provided under the holding member 104, and presses the edge face of the plurality of metal plates 103 to the fixing roller 101 through the fixing belt 102 according to the energization force of the compression spring 105. Furthermore, in order to improve the slidability of the plurality of metal plates 103 and the fixing belt 102, at least, the portion, which opposes to the fixing roller 101 in the aggregate of the metal plates 103, is covered with the sheet 106 of the low friction, for example, with the fluororesin PFA having the thickness of 50 μm. By this, the metal plate 103 does not directly contact the fixing belt 102.

In addition, the plurality of metal plates 103, the holding member 104, the compression spring 105 and sheets 106 are equivalent to a pressing device in a claim.

And these members are held with a holder 108 formed from heat-resistant resin.

An oil pad 112, which is formed from sponge, contains the lubricant formed from silicone oil, is held by a holder 109, and is contacted by pressure to the inner circumference side of the fixing belt 102. And, since the lubricant is supplied to the inner circumference side of the fixing belt 102, slide resistance of the fixing belt 102 becomes still smaller.

Holders 108 and 109 are held by a metal flame 110 arranged in the center. In addition, the holders 108 and 109 also have a function as an inside material for guiding the fixing belt 102 at the time of rotation of the fixing belt 102.

In the belt fixing apparatus 100 configured in this way, the fixing roller 101 is heated by a halogen lamp H and driven by an unillustrated driving device. Then, the fixing roller 101 rotates clockwise. In addition, the plurality of metal plates 103 are pressed with the compression spring 105. As a result the metal plates 103 press the fixing belt 102 from the inner circumference side through a sheet 106, and make the fixing belt 102 contact the fixing roller 101.

Therefore, since the fixing belt 102 rotates counterclockwise, contacts the fixing roller 101 by pressure and the fixing belt 102 is elastically deformed into a concave when the fixing roller 101 rotates, the broad nip portion N is formed between the fixing belt 102 and the fixing roller 101. And the conveyed recording paper sheet P is nipped in the nip portion N, and the unfixed toner on the recording paper sheet P is heated and pressurized, and it is fixed onto the recording paper sheet P.

In addition, there is provided a crimp releasing device for estranging the fixing belt 102 from the fixing roller 101 with the plurality of metal plates 103 and releasing the crimp to the fixing roller 101 by the fixing belt 102, which is used when fixing recording paper jam and conducting maintenance. This crimp releasing device will be described with reference to FIGS. 3 (*a*) and 3 (*b*).

Figure 3:
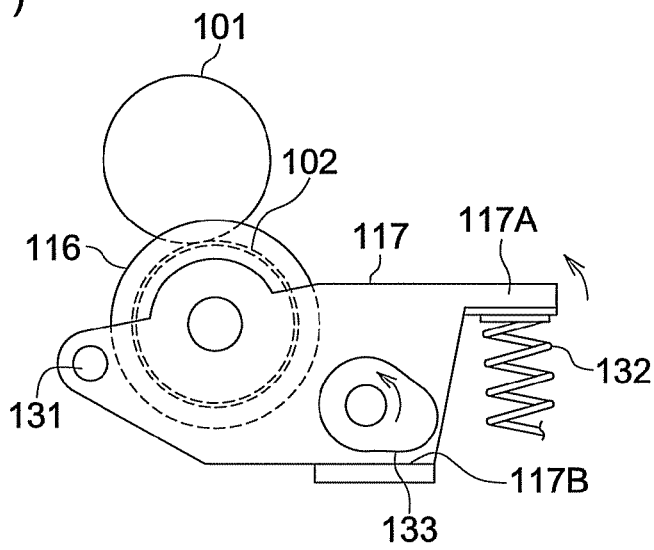
FIGS. 3 (*a*) and 3 (*b*) illustrate a crimp release device.
Figure 3:
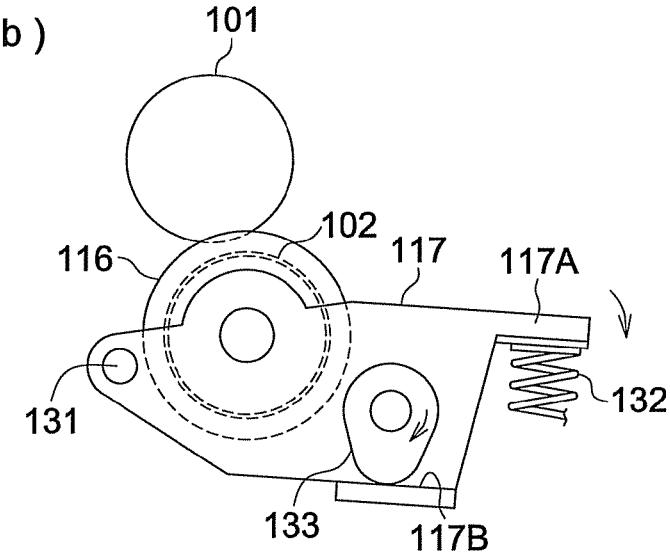

FIG. 3 (*a*) is a figure illustrating the status at the time of use of the fixing apparatus, and FIG. 3 (*b*) is a figure, in which the crimp to the fixing roller 101 by the fixing belts 102 has been released.

In FIG. 3 (*a*), a swing member 117 is pivotally supported by a support shaft 131 and is capable of rotating. And an edge 117A of the swing member 117 is pressed by the compression spring 105, and the swing member 117 is energized counterclockwise. Therefore, the fixing belt 102 is also rotated through the support member 116, which supports the above-mentioned flame 110, and the fixing belt 102 is pressed and contacted by the fixing roller 101 with pressure.

On the other hand, when releasing the crimp to the fixing roller 101 by the fixing belts 102, a cam 133 is rotated as illustrated in FIG. 3 (*b*). When the cam 133 rotates, the bottom 117B of the swing member 117 is pressed by the cam 133, and the swing member 117 swings as resisting the energization force of the compression spring 132. Therefore, since the fixing belt 102 are also swings through the support member 116 and the fixing belt 102 is estranged from the fixing roller 101, the crimp to the fixing roller 101 by the fixing belts 102 is released.

Thus, the pressing force to the nip portion N becomes settled by the spring pressure from the compression spring 105 and the spring pressure by the compression spring 132.

Figure 4:
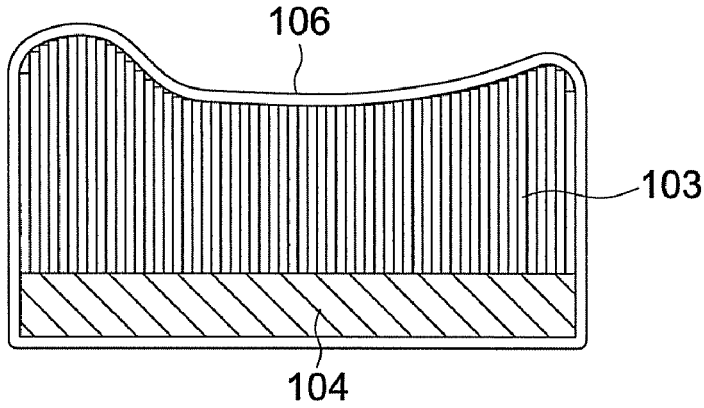
FIG. 4 illustrates an enlarged drawing of a plurality of metal plates.

Here, as illustrated in the enlarged view of FIG. 4, each metal plate 103 is formed so that the edge face of the plurality of metal plates 103, which oppose the fixing roller 101, may become the form along the contour of the fixing roller 101 except for the portion near the most downstream side in the conveyance direction of the recording material P. That is, the edge face of the plurality of metal plates 103 is formed in the concave shape, which substantially equals to the circle of a value obtained by adding the thickness of the fixing belt 102 and the thickness of the sheet 106 to the radius of the fixing roller 101. Therefore, since the plurality of metal plates 103 manufactured into predetermined form and size in advance is combined and used, it becomes possible to surely make a uniform pressure distribution in the nip portion N. Therefore, unlike the case where it becomes uneven pressure distribution by processing using conventional rubber, it becomes difficult to generate image defects, such as an image gap.

However, in the portion near the most downstream side in the conveyance direction lowest of the recording material P, the length of the plurality of metal plates 103 is formed longer, and pressing force is strengthened. Thereby, the plurality of metal plates 103 presses the fixing belt 102 to the fixing roller 101 through a sheet 106 and elastically deforms the elastic layer 101B and the releasing layer 101C of the fixing roller 101 into the large concave of curvature. Therefore, the recording paper sheet P, to which an image has been fixed in the nip portion N, can be surely exfoliated from the fixing roller 101 without using a separation claw and the like.

In addition, in FIG. 4, the length of the plurality of metal plates 103 is respectively changed so that the above-mentioned conditions may be matched. However, in case when the portion of the side of the metal plate 103 in the holding member 104 is formed in a curve so that it may become a curve, which is formed by the edge face of the plurality of metal plates 103, the length of each metal plate 103 can be manufactured in the same length.

Thus, it becomes possible to form a continuous pressure distribution by changing the length of the metal plate 103, or the height of the metal plate 103 from the predetermined surface in the holding member 104.

In addition, plate thickness of the plurality of metal plates 103, which can be set near the most downstream side in the conveyance direction of the recording material P may be made thicker than the other metal plates 103, and pressing force may be strengthened.

Thus, it is not necessary to partially lengthen the metal plate 103 in particular, and the increase of hardness and durable performance can be improved by changing plate thickness.

As an example of the above metal plate 103, there is used a metal plate having an average length of 10 mm, the depth in the direction, which perpendicularly crosses with the conveyance direction of the recording material P, being set to 350 mm and the plate thickness being set to 0.05 mm. When nip width shall be 10 mm, at this time, the total number of the metal plate 103 will be 200 sheets.

As for the metal plate 103, it is desirable to be formed by phosphor bronze (Young's modulus 1.13E+11) or nickel (Young's modulus 2.19E+11).

Therefore, it is desirable to use phosphor bronze in the case of the fixing apparatus having a weak nip pressure to fix a monochrome picture or non-coated paper. And it is desirable to use nickel in the case of the fixing apparatus having a strong nip pressure to fix a color image or coated paper.

In addition, it is desirable to set the surface on the nip portion N at 100-1000 kPa.

In addition, with respect to the metal plate 103, which is located near the most downstream side in the conveyance direction of the recording material P and is arranged to conduct an exfoliation operation, nickel having a higher Young's modulus may be used. With respect to other metal plates 103, phosphor bronze having a lower Young's modulus may be used.

Thereby, it is not necessary to partially lengthen the metal plate 103 in particular, and the hardness is increased and durable performance can be improved.

In addition, as for each metal plate 103, it is desirable to be held in the status that metal plates 103 closely contact each other in the holding member 104.

Furthermore, since the metal plate 103 will be bent in the nip portion N to the conveyance direction and the downstream side of the recording material P at the time of use, actually, the edge of the metal plate 103 presses the fixing belt 102 through a sheet 106. Therefore, it is desirable to, at least, circularly round off the edge of the conveyance direction upstream side of the recording material P, when manufacturing the metal plates.

In addition, when the press processing of the metal plate 103 is carried out, the portion formed in a round edge in an edge face is arranged to the conveyance direction upstream of the recording material P, and the portion of the burr formed in an edge face may be arrange to the conveyance direction downstream of the recording material P.

In addition, instead of the above-mentioned metal plate 103, a plurality of metal wires may be used as a metal member. In this case, the edge face (torn surface cut perpendicularly to the longitudinal direction) of each metal wire opposes with the fixing roller 101, and is arranged in the shape of a brush.

In addition, the diameter of the plurality of metal wires, which can be set near the most downstream side in the conveyance direction of the recording material P, may be made thicker than other metal wires, and pressing force may be strengthened more.

Thereby, it is not necessary to partially lengthen the metal wire in particular, and the hardness is increased and durable performance is improved.

The length of the metal wire is the same as that of the above-mentioned metal plate 103, and phosphor bronze and nickel of the quality of the material are similarly desirable. For example, in cases where the metal wire having a diameter of 0.3 mm is used and when the width of the nip portion N is set to 10 mm and the depth is set to 350 mm, 33 metal wires are arranged in the width direction, 1167 metal wires will be arranged in the depth direction and total number of wires used for it will be 38511.

In addition, with respect to the metal wire, which is located near the most downstream side in the conveyance direction of the recording material P and is arranged to conduct an exfoliation operation, nickel having a higher Young's modulus may be used. With respect to other metal wire, phosphor bronze having a lower Young's modulus may be used.

Thereby, it is not necessary to partially lengthen a metal wire in particular, and the hardness is increased and durable performance is improved.

Furthermore, in the nip portion N, it can prevent that a crease occurs on the recording paper sheet P by strengthening the pressing force of the central portion more than that of the edge in the direction, which perpendicularly crosses with the conveyance direction of the recording material P. For this reason, the metal plate 103 may be formed into a mountain shape where the central part is high. In addition, in the case of a metal wire, the central portion may be lengthen or shaped thick. Or, it may be formed by a material having a higher Young's modulus.

In addition, adhesion may be used although outsert molding is desirable as a processing method for the holding member 104 to hold the metal plate 103 and a metal wire.

By the way, in order to press the nip portion like the above, it is not limited to the belt fixing apparatus of the FBNF system illustrated in FIG. 2 as belt fixing apparatus using the metal plate and metal wire, which are metal members. The belt fixing apparatus of other systems will be explained based on FIGS. 5 and 6 below.

Figure 5:
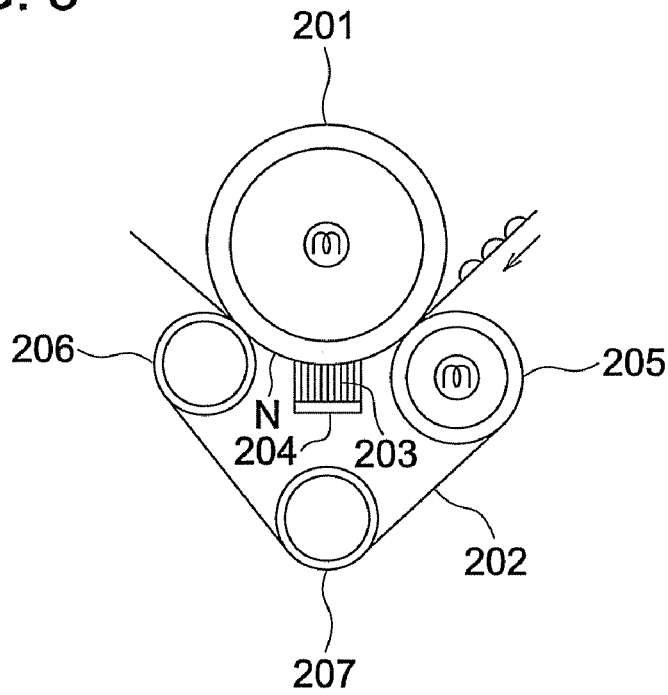
FIG. 5 illustrates a sectional view of a belt fixing apparatus of another system.

As for the belt fixing apparatus illustrated in FIG. 5, a fixing belt 202 is wound around a lower heating roller 205, a separation roller 206 and a tension roller 207. And a plurality of metal plates 203 (metal member) held by a holding member 204 are arranged to press an upper heating roller 201 (fixing member) through a fixing belt 202. This structure has prevented that the fixing belt 202 loosens in the center of the nip portion N formed by the fixing belt 202 and the upper heating roller 201, and pressure distribution becomes uneven.

Figure 6:
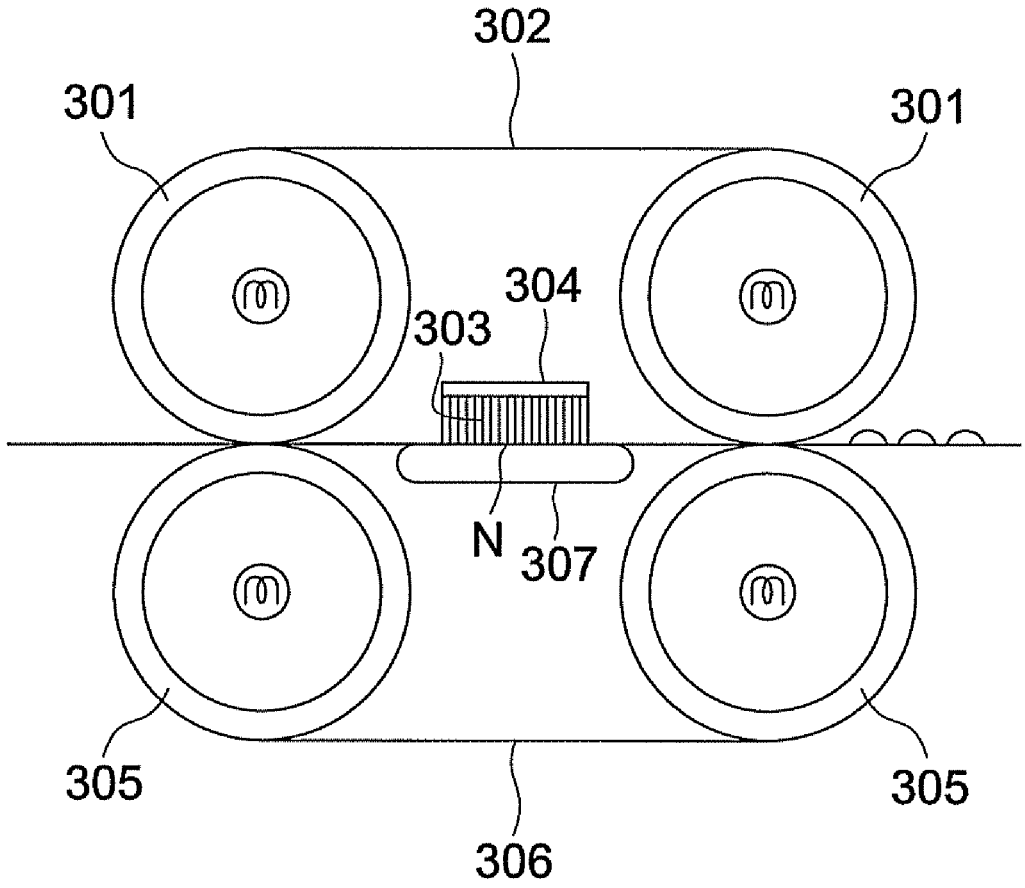
FIG. 6 illustrates a sectional view of a belt fixing apparatus of another system.

In the belt fixing apparatus illustrated in FIG. 6, the fixing belt 302 is wound around two upper heating rollers 301, which are located upwards, and the fixing belt 306 (fixing member) is wound around two lower heating rollers 305, which are located downward. And a plurality of metal plates 303 (metal member) held by the holding member 304 presses the fixed member 307 through the fixing belts 302 and 306. Thereby, it is prevented that the pressure distribution becomes uneven in the center of the nip portion N, to which two fixing belts 302 and 306 are contacting, in case when, at least, either one of two fixing belts 302 and 306 loosens.

Although these metal plates 203 and 303 are formed as well as the above-mentioned metal plate 103, they may be the above-mentioned metal wire.

In addition, there may also be a fixing apparatus having a structure other than FIGS. 5 and 6. However, the direction, in which the metal plate 103 or the metal wire is pressed to a fixing member, may be the surface where the toner on a recording material is transferred, or may be the back surface. Either one may be acceptable.

According to a belt fixing apparatus and an image forming apparatus of the present invention, since a fixing belt is allowed to contact a fixing member with pressure by using the aggregate of a plurality of metal members manufactured into predetermined form and size in advance, a processing error does not arise and desired pressure distribution is acquired in a nip portion. Therefore, there is no possibility that the fixed luminous intensity and density of an image may become uneven, an image gap may occur, or a crease may occur on the recording paper as a recording material. In addition, it is possible to strengthen arbitrarily the pressing force near the most downstream side in the conveyance direction in a nip portion, and without using a separating claw, the recording media, onto which an image has been fixed in the nip portion, can also be surely exfoliated and can be separated from a fixing member.

What is claimed is:

1. A belt fixing apparatus for fixing a toner image on a recording material in a nip portion comprising:

an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material; and wherein a length of each of the plurality of metal members at a portion near the most downstream side in the conveyance direction in the nip portion is longer than the length of each of the plurality of metal members at a portion other than the potion near the most downstream side.

2. A belt fixing apparatus for fixing a toner image on a recording material in a nip portion comprising:

an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material;

wherein the metal members are metal plates; and wherein each thickness of the metal plates at a portion near the most downstream side in the conveyance direction in the nip portion is more thick than that of metal plates at a portion other than the portion near the most downstream side.

3. A belt fixing apparatus for fixing a toner image on a recording material in a nip portion comprising:

an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material;

wherein the metal members are metal wires and arranged in a brush form; and wherein each diameter of the metal wires at a portion near the most downstream side in the conveyance direction in the nip portion is larger than that of metal plates at a portion other than the portion near the most downstream side.

4. A belt fixing apparatus for fixing a toner image on a recording material in a nip portion comprising:

an endless fixing belt and a pressing device to press the fixing belt to a fixing member so as to form the nip portion between the fixing belt and the fixing member, wherein the pressing device is structured from an aggregate of a plurality of metal members arranged in a conveyance direction of the recording material; and wherein the plurality of metal members at a portion near the most downstream side in the conveyance direction in the nip portion are composed of a material having a higher Young's modulus than that of the plurality of metal members at a portion other than the portion near the most downstream side.

* * * * *